US007980231B1

(12) United States Patent
Belter et al.

(10) Patent No.: US 7,980,231 B1
(45) Date of Patent: Jul. 19, 2011

(54) OUTBOARD MOTOR WITH AN EXHAUST GAS RECIRCULATION SYSTEM AND AN IDLE EXHAUST RELIEF SYSTEM

(75) Inventors: David J. Belter, Oshkosh, WI (US); Keith W. Gessner, Kewaskum, WI (US)

(73) Assignee: Brunswick Corporation, Lake Forest, IL (US)

( * ) Notice: Subject to any disclaimer, the term of this patent is extended or adjusted under 35 U.S.C. 154(b) by 483 days.

(21) Appl. No.: 12/139,792

(22) Filed: Jun. 16, 2008

(51) Int. Cl.
*F02M 25/07* (2006.01)
*F02B 47/08* (2006.01)
*B63H 21/34* (2006.01)

(52) U.S. Cl. ..... 123/568.11; 440/89 G

(58) Field of Classification Search ..... 123/568.11, 123/568.12, 568.17–568.21; 440/84, 89 R, 440/89 G, 89 H, 89 J; 60/312–314, 323, 60/324
See application file for complete search history.

(56) References Cited

U.S. PATENT DOCUMENTS

| | | | | |
|---|---|---|---|---|
| 4,601,666 | A * | 7/1986 | Wood, Jr. | 440/89 R |
| 4,773,215 | A * | 9/1988 | Winberg et al. | 440/89 G |
| 4,914,911 | A * | 4/1990 | Bertram | 440/89 G |
| 4,995,233 | A * | 2/1991 | Lulloff | 60/324 |
| 5,070,838 | A | 12/1991 | McKay | |
| 5,163,295 | A | 11/1992 | Bradshaw | |
| 6,302,751 | B1 * | 10/2001 | Nanami | 440/89 G |
| 7,625,257 | B1 * | 12/2009 | Broman et al. | 440/89 B |
| 7,892,057 | B1 * | 2/2011 | Belter | 440/89 G |
| 2007/0039314 | A1 | 2/2007 | Mizuguchi | |
| 2008/0053419 | A1 | 3/2008 | Pierpont | |

FOREIGN PATENT DOCUMENTS

| | | | | |
|---|---|---|---|---|
| JP | 09109995 | A * | 4/1997 | 123/568.12 |

* cited by examiner

*Primary Examiner* — Willis R Wolfe, Jr.
(74) *Attorney, Agent, or Firm* — William D. Lanyi

(57) ABSTRACT

A control system for an outboard motor provides an EGR valve and an idle exhaust relief valve which are under the control of a controller that opens and closes the valves as a function of the rotational speed of a crankshaft of the engine. The EGR valve controls the flow of exhaust gas from an exhaust gas conduit to an air intake manifold. The idle exhaust relief valve controls the flow of exhaust gas from the exhaust conduit to a location at atmospheric pressure. In addition, the idle exhaust relief valve is used to allow air to flow from the atmosphere into the exhaust conduit when the engine is turned off.

18 Claims, 2 Drawing Sheets

OUTBOARD MOTOR WITH AN EXHAUST GAS RECIRCULATION SYSTEM AND AN IDLE EXHAUST RELIEF SYSTEM

BACKGROUND OF THE INVENTION

1. Field of the Invention

The present invention is generally related to an outboard motor and, more particularly, to an outboard motor that incorporates both an exhaust gas recirculation system and an idle exhaust relief system.

2. Description of the Related Art

Those skilled in the art of outboard motors are very familiar with idle exhaust relief systems which provide an alternative exhaust passage to conduct exhaust gas away from the engine when the engine is operating at relatively low speeds. Those skilled in the art of internal combustion engines are generally familiar with exhaust gas recirculation (EGR) systems. Exhaust gas recirculation systems are widely used in conjunction with automobile engines to recirculate a portion of an exhaust gas stream back to an intake system of the engine. This recirculation is helpful in controlling certain types of exhaust gas pollutants.

U.S. Pat. No. 5,070,838, which issued to McKay on Dec. 10, 1991, describes an integrated idle air and exhaust gas recirculation system. The system has a single valve assembly to control both idle air and exhaust gas being supplied to the engine. The valve assembly has a solenoid actuated two-way valve for switching from air to exhaust gas as a source, and a metering valve for controlling the quantity of gas, either idle air or exhaust gas, allowed to enter the engine intake.

U.S. Pat. No. 5,163,295, which issued to Bradshaw on Nov. 17, 1992, describes a system for controlling exhaust gas recirculation in a pressure boosted internal combustion engine. A valve seat is provided in the EGR passage and a hollow actuator rod is moved by a pressure responsive diaphragm to control flow. The diaphragm senses boost inlet pressure in a chamber supplied through a port in the rod which extends through the boost air inlet passage. In another embodiment a restrictor valve is provided in the exhaust pipe downstream of the EGR passage. The valve is closed at idle to divert exhaust to the EGR passage. As boost pressure increases, a separate pressure tap supplies a second pressure responsive diaphragm to open the restrictor valve.

U.S. patent application Ser. No. 11/503,740, which was filed by Mizuguchi on Feb. 22, 2007, describes an exhaust purifier for a diesel engine. A controller for an exhaust purifier performs idle-up to increase the idle speed of a diesel engine when an intake air amount, which is based on the atmospheric pressure and the engine speed, is less than a reference air amount of when a throttle valve is completely open and an EGR valve is completely closed during the regeneration of the filter. The controller performs idle-up by increasing the amount of fuel injected from the fuel injection valves of the diesel engine.

U.S. patent application Ser. No. 11/513,104, which was filed by Pierpont on Mar. 6, 2008, describes a low idle exhaust gas recirculation system. The system is provided for reducing NOx emitted from the power source at low idle speeds. The power source has at least one combustion chamber, an intake manifold, a first exhaust manifold, and a second exhaust manifold. The exhaust recirculation system has as valve located in at least one of the first and second exhaust manifolds. The valve is movable to increase the temperature of an exhaust gas by directing exhaust gas from the at least one of the first and second exhaust manifolds to the intake manifold. Furthermore, the exhaust recirculation system has a controller configured to determine at least one power source condition indicative of an exhaust temperature and move the valve in response to the determination.

The patents described above are hereby expressly incorporated by reference in the description of the present invention.

SUMMARY OF THE INVENTION

A marine propulsion device in accordance with a preferred embodiment of the present invention comprises an engine, an intake conduit configured to direct air into at least one combustion chamber of the engine, an exhaust conduit configured to direct exhaust gas from the at least one combustion chamber of the engine, an exhaust gas recirculation conduit connected in fluid communication between the exhaust conduit and the intake conduit, an exhaust gas recirculation valve disposed in fluid communication with the exhaust gas recirculation conduit and configured to selectively inhibit the flow of the exhaust gas through the exhaust gas recirculation conduit, an idle exhaust relief conduit connected in fluid communication with the exhaust conduit, and an idle exhaust relief valve disposed in fluid communication with the idle exhaust relief conduit and configured to selectively inhibit the flow of gas through the idle exhaust relief conduit.

In a preferred embodiment of the present invention, the exhaust gas recirculation valve has an open state which permits exhaust gas to flow through the exhaust gas recirculation conduit and a closed state which inhibits the exhaust gas from flowing through the exhaust gas recirculation conduit. In a preferred embodiment of the present invention, the idle exhaust relief valve has an open state which permits the gas to flow through the idle exhaust relief conduit and a closed state which inhibits the gas from flowing through the idle exhaust relief conduit.

In a particularly preferred embodiment of the present invention, it further comprises a sensor configured to provide a signal which is representative of an operating speed of the marine propulsion device. The sensor can be a rotational speed sensor and the operating speed of the marine propulsion device can be the rotational speed of a crankshaft of the engine.

In a preferred embodiment of the present invention, it can further comprise a controller which is connected in signal communication with the sensor, the exhaust gas recirculation valve and the idle exhaust relief valve. The controller can be configured to place the idle exhaust relief valve in an open state in response to the signal being less than a first preselected magnitude. It can also be configured to place the idle exhaust relief valve in the closed state in response to the signal being greater than a second preselected magnitude. The controller can be configured to place the exhaust gas recirculation valve in its open state in response to the engine being turned off. In addition, the controller can be configured to place the exhaust gas recirculation valve in the closed state in response to the signal being less than a third preselected magnitude.

In certain embodiments of the present invention, the controller is configured to place the exhaust gas recirculation valve in a partially open condition in response to the signal being less than a maximum speed of the engine, such as wide open throttle, and greater than the third preselected magnitude. The condition of the exhaust gas recirculation valve is determined as a function of the magnitude of the signal between the third preselected magnitude and the maximum speed of the engine in a preferred embodiment of the present invention.

In a preferred embodiment of the present invention, the controller is configured to coordinate the operation of the exhaust gas recirculation valve and the idle exhaust relief valve as a function of the signal. The controller can comprise a microprocessor and can be a part of an engine control unit (ECU) of an outboard motor.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
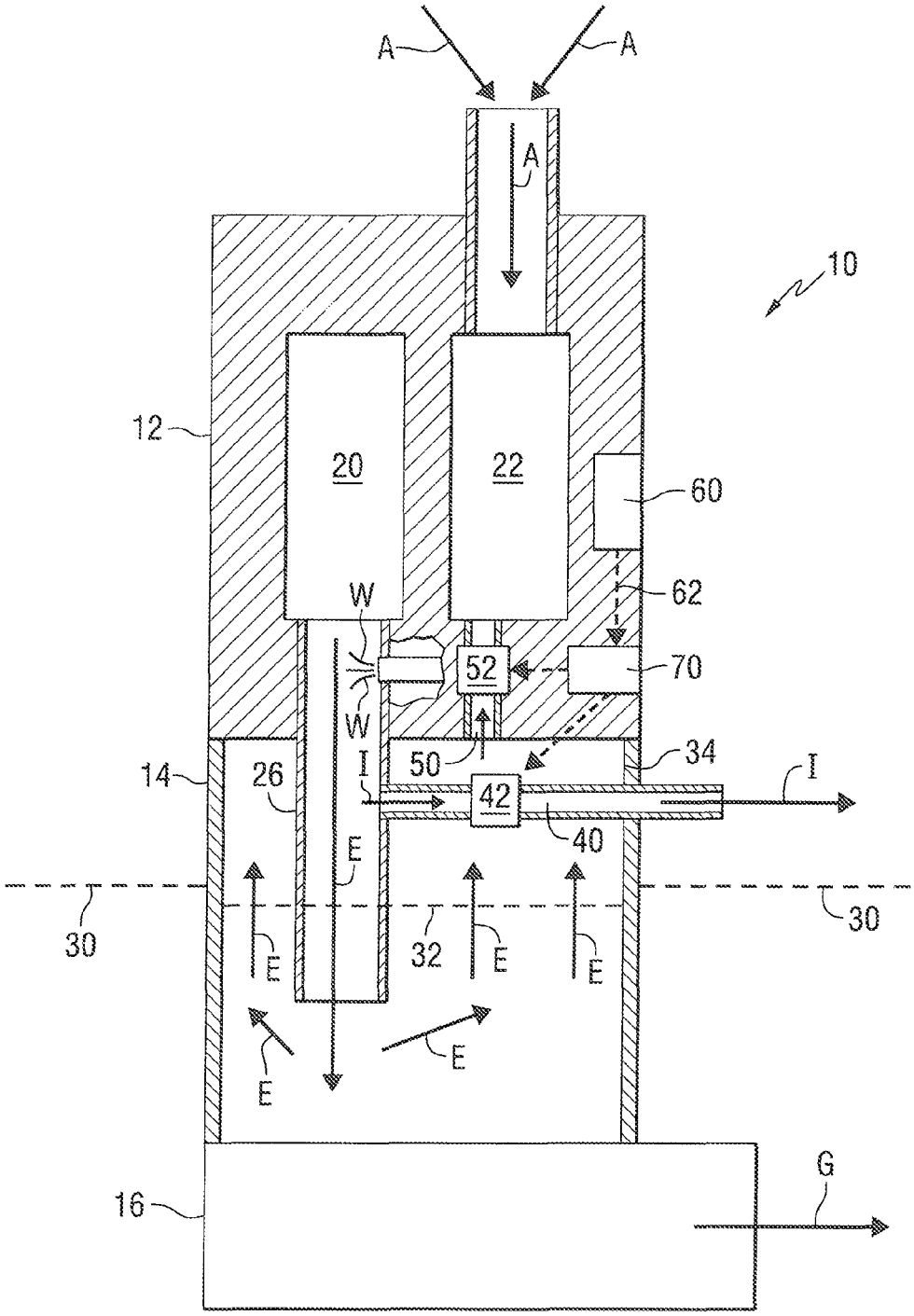
FIG. 1 is a simplified schematic representation of an outboard motor.

Throughout the description of the preferred embodiment of the present invention, like components will be identified by like reference numerals.

FIG. 1 is a highly schematic representation of an outboard motor 10 which incorporates a preferred embodiment of the present invention. An engine 12 is attached to a driveshaft housing 14 which, in turn, comprises a gear case 16 that is configured to support a propeller shaft (not shown in FIG. 1) for rotation about a generally horizontal axis. The engine 12 has an exhaust conduit 20 and an air intake manifold 22 which are both connected in fluid communication with one or more combustion chambers of the engine 12 in a manner which is generally well known to those skilled in the art. Air, which is designated by arrows A in FIG. 1, is directed into the air intake manifold 22 and conducted into the combustion chambers (not shown in FIG. 1) in a manner that is generally well known to those skilled in the art. Exhaust gas is directed from the combustion chambers by the exhaust conduit 20 and further conducted downwardly, in FIG. 1, into the driveshaft housing 14 by an exhaust passageway 26.

With continued reference to FIG. 1, dashed line 30 represents the position of a surface of a body of water relative to the outboard motor 10 when the engine 12 is operating at idle speed. An internal level 32 of water within the driveshaft housing 14 is represented by dashed line 32. Because of the flow of exhaust gas E into the driveshaft housing 14, a slight pressure differential exists between chamber 34 in the driveshaft housing 14 and atmospheric pressure. This pressure differential may be slight. As is generally known to those skilled in the art, many types of outboard motors 10 are provided with an idle exhaust relief conduit 40, or passage, which allows exhaust gas I to flow from the exhaust conduit, or exhaust passage 26, and be emitted from the outboard motor 10. The provision of an idle exhaust relief conduit 40 facilitates the operation of the engine 12 because it removes the necessity of the engine to produce sufficient pressure to lower the water level 32 below the primary exhaust passage through the gear case 16 which is identified by arrow G in FIG. 1. During operation at elevated speeds of the engine 12, the exhaust gas E creates sufficient pressure within the driveshaft housing 14 to lower the water level 32 and cause the exhaust gas to be emitted through the gear case 16 and propeller hub. In addition, elevated operating speeds of the engine 12 will typically induce the associated marine vessel to increase in velocity and raise the outboard motor 10 relative to the surface 30 of the body of water in which it is operating. The level 32 of water within the driveshaft housing 14 will therefore be lowered in relation to where it is shown in FIG. 1.

With continued reference to FIG. 1, the engine 12 is provided with an exhaust gas recirculation (EGR) conduit 50 which connects the exhaust conduit 20 in fluid communication with the intake conduit 22. The exhaust gas E would flow downwardly from the exhaust conduit 20 into the chamber 34 of the driveshaft housing 14 and upwardly through the EGR conduit 50 toward the intake manifold 22, or intake conduit. The exhaust gas recirculation conduit 50 is provided with a valve 52 and the idle exhaust relief conduit 40 is provided with a valve 42.

In addition to the components described above in conjunction with FIG. 1, the engine 12 is also provided with a rotational speed sensor 60 and an engine control unit 70 which provides a controller that can comprise a microprocessor. The rotational speed sensor 60 serves as a sensor which is configured to provide a signal as represented by dashed line arrow 62. The signal is usually representative of an operating speed of the marine propulsion device 10 and, more particularly, provides information relating to the rotational speed of the crankshaft of the engine 12. The controller 70 is configured to control the idle exhaust relief valve 42 and the exhaust gas recirculation valve 52, as represented by the dashed line arrows connecting these components.

With continued reference to FIG. 1, it should be understood that during increased speed of the outboard motor 10, above the idle speed of engine 12, the exhaust gas E flows downwardly from the exhaust conduit 20 through the exhaust passage 26 into a cavity of the driveshaft housing 14 and then into the exhaust gas recirculation conduit 50. If the EGR valve 52 is open, the exhaust can flow into the air intake manifold 22 and into the combustion chambers of the engine 12. The EGR valve 52 can therefore be used to regulate the amount of exhaust flowing into the air intake manifold 22. The idle exhaust relief conduit 40 is typically operated at relatively low operating speeds of the engine 12, such as at idle speed, and is not needed when the engine 12 reaches elevated speeds that are sufficient to raise the outboard motor 10 to an elevation that allows the exhaust G to flow through the gear case 16 and propeller hub. It should therefore be understood that the exhaust gas will probably not be flowing through both the exhaust gas recirculation conduit 50 and the idle exhaust relief conduit 40 at the same time for extended durations.

Figure 2:
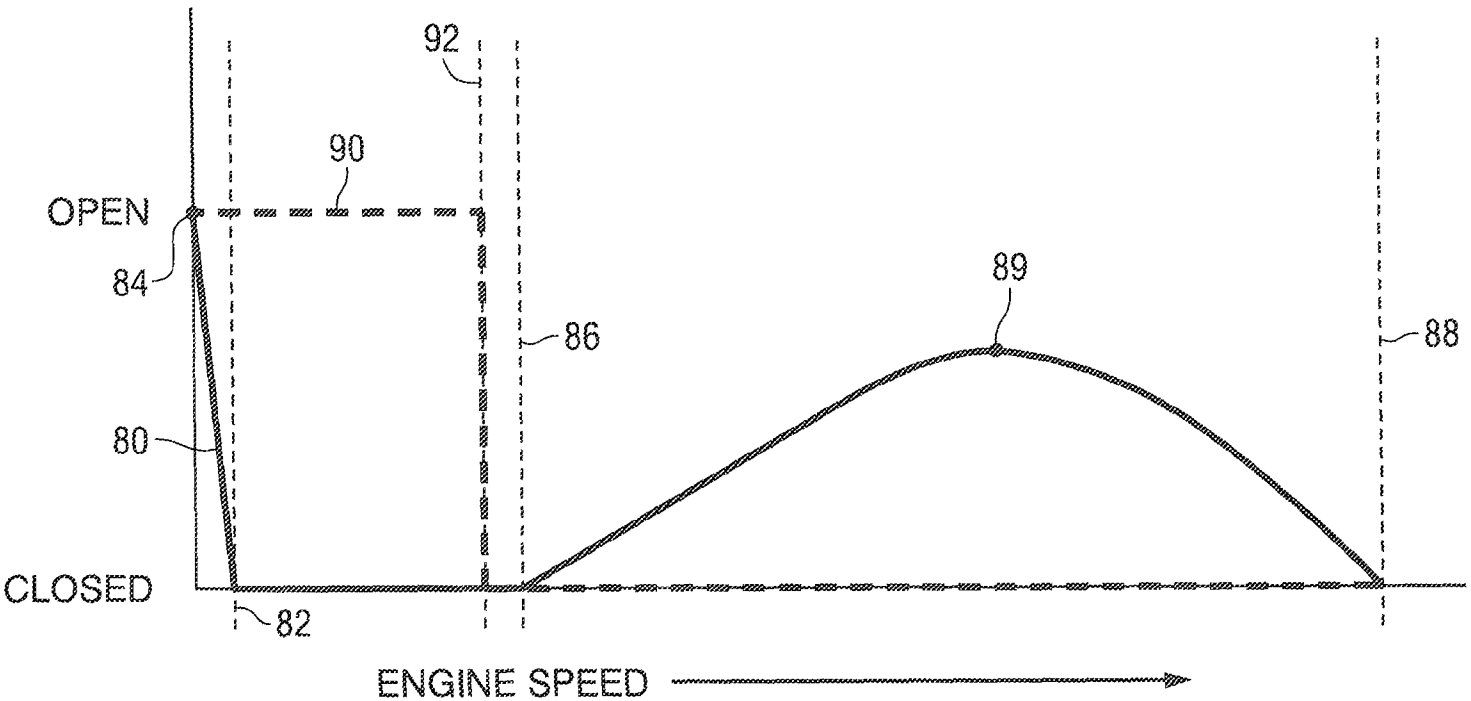
FIG. 2 is a graphical representation of the opened and closed status of an EGR valve and an idle exhaust relief valve.

FIG. 2 is a graphical representation showing the status of the two valves of the present invention as described above. The solid line 80 represents the status, in terms of its open or closed condition, of the exhaust gas recirculation valve 52. The dashed line 90 represents the status of the idle exhaust relief valve 42. The portion of the solid line to the left of dashed line 82 is intended to represent the rapid change from an open condition to a closed condition that is intended to take place during initial startup of the engine. The size of the distance to the left of dashed line 82 is exaggerated for the purpose of illustration, but it should be understood that during the initial stages of startup, when a marine vessel operator turns the ignition key or pushes a start button, the EGR valve 52 is rapidly closed. In most applications, it is closed before the crankshaft of the engine 12 begins to rotate. In certain embodiments of the present invention, the EGR valve 52 is briefly opened during shutdown and then closed. This is down to prevent certain disadvantageous results from occurring, such as water intrusion.

With continued reference to FIGS. 1 and 2, it should be understood that the controller 70 in a preferred embodiment of the present invention is configured to place the idle exhaust relief valve 42 in an open state in response to the signal from the sensor 60 being less than a first preselected magnitude which is represented by dashed line 92 in FIG. 2. This first preselected magnitude can typically be generally equivalent to the idle speed of the engine 12. The controller 70 is configured to place the idle exhaust relief valve 42 in a closed state in response to the signal from the rotational speed sensor being greater than a second preselected magnitude which is also generally equivalent to dashed line 92. These first and second preselected magnitudes can be different from each other in certain embodiments of the present invention if it is desirable, for any reason, to use different engine speeds as the threshold magnitudes to close the idle exhaust relief valve when the engine speed is increasing and to open it as the engine speed is decreasing.

With continued reference to FIGS. 1 and 2, the controller 70 is configured to place the EGR valve 52 in an open state when the engine is turned off. This is identified as point 84 in FIG. 2. The controller 70 is configured to place the EGR valve in a closed state in response to the signal from the rotational speed sensor being less than a third preselected magnitude which is represented by dashed line 86 in FIG. 2. The controller 70 is configured to place the EGR valve 52 in a partially opened condition in response to the signal being less than a maximum speed of the engine and greater than the third preselected magnitude 86. The condition of the exhaust gas recirculation valve is determined as a function of the magnitude of the signal between the third preselected magnitude 86 and the maximum speed of the engine 88. This relationship is represented by an upward sloping portion of line 80 between dashed line 86 and point 89 and a downward sloping portion of line 80 between point 89 and dashed line 88. However, it should be understood that the continuous control of the EGR valve 52 as a function of engine speed, between line 86 and 88, is not limiting to the present invention.

With continued reference to FIGS. 1 and 2, it can be seen that the EGR valve 52 remains closed from the point in time when the engine is started to the achievement of the third preselected 86 and the status of the EGR valve is changed during the increase in engine speed from the third preselected magnitude 86 to point 89. This change in the status of the EGR valve, from a completely closed state to a partially open state can continue all the way to the maximum speed 88 in certain embodiments of the present invention, but the specific control of the EGR valve between dashed lines 86 and 88 is not limiting to its breadth. In addition, dashed lines 90 represent the control of the idle exhaust relief valve 42. Simply stated, it remains open from an engine off condition to the achievement of the first preselected magnitude 92 in order to facilitate the operation of the engine 12 and allow exhaust gas I to pass through the idle exhaust relief conduit 40. Above idle speed, the idle exhaust relief valve 42 is usually closed. FIG. 2 shows the coordination of the idle exhaust relief valve 42 and the EGR valve 52 in one embodiment of the present invention.

This coordination of the operation of the idle exhaust relief valve 42 and EGR valve 52 provides several advantages. First, by closing the idle exhaust relief valve 42 when the engine 12 achieves an operating speed above idle speed, the noise that would otherwise escape through the idle exhaust relief conduit 40 is reduced. Furthermore, by opening the idle exhaust relief valve 42 when the engine 12 is turned off, a pressure equalization is provided through the exhaust conduit 20 and the combustion chambers if some of the exhaust valves are open during the off condition of the engine. During this type of condition, air would flow from the atmosphere through the idle exhaust relief conduit 40 and into the exhaust conduit 20 if the idle exhaust relief valve 42 remains open. This pressure equalization function helps to prevent a low pressure within the exhaust conduit 20 that is lower than atmospheric pressure. Under certain conditions, this lower pressure within the exhaust conduit 20 could be sufficient to draw water in a reverse direction and into the cylinders of the engine 12. An open idle exhaust relief valve 42 helps to avoid this potentially deleterious situation. These, and other advantageous results, can be achieved through the coordination of the idle exhaust relief valve 42 and EGR valve 52. In a preferred embodiment of the present invention, it is speed sensitive but, in alternative embodiments, the controller can be responsive to a throttle position sensor, an oxygen sensor or an exhaust pressure sensor.

With continued reference to FIGS. 1 and 2, it can be seen that a marine propulsion device made in accordance with a preferred embodiment of the present invention comprises an engine 12, an intake conduit 22 configured to direct air into at least one combustion chamber of the engine 12, an exhaust conduit 20 configured to direct exhaust gas E from the at least one combustion chamber of the engine, an exhaust gas recirculation conduit 50 connected in fluid communication between the exhaust conduit 20 and the intake conduit 22, an exhaust gas recirculation valve 52 disposed in fluid communication with the exhaust gas recirculation conduit 50 and configured to selectively inhibit the flow of the exhaust gas E through the EGR conduit 50, an idle exhaust relief conduit 40 connected in fluid communication with the exhaust conduit 20, and an idle exhaust relief valve 42 disposed in fluid communication with the idle exhaust relief conduit 40 and configured to selectively inhibit the flow of gas through the idle exhaust relief conduit. As described in the preferred embodiment of the present invention, the gas flowing through the idle exhaust relief conduit 40 can be exhaust gas I passing out of the outboard motor 10 or, when the engine is turned off, it can be air flowing from the atmosphere into the exhaust conduit 20 if differential pressures are sufficient to cause this direction of flow through the open idle exhaust relief valve 42. It should be understood that most embodiments of the present invention would also incorporate a water conduit that is configured to inject water W into the exhaust passage 26 to reduce the temperature of the exhaust gas E as it flows downwardly from the exhaust conduit 20 and through the exhaust passage 26. This water injection is typically located upstream from the connection between the idle exhaust relief conduit 40 and the exhaust conduit 20. However, it should be clearly understood that the provision of this water conduit to inject water W into the exhaust flow and its location relative to the idle exhaust relief conduit 40 is not limiting to the present invention.

A preferred embodiment of the present invention further comprises a sensor 60, such as a rotational speed sensor, which is configured to provide a signal 62 that is representative of an operating speed of the marine propulsion device 10, such as the rotational speed of a crankshaft of the engine 12. A controller 70, such as an engine control unit with a microprocessor, is connected in signal communication with the sensor 60, the exhaust gas recirculation valve 52, and the idle exhaust relief valve 42. The controller 70 is configured to place the idle exhaust relief valve 42 in an open state in response to the signal being less than a first preselected magnitude 92 and to place the idle exhaust relief valve 42 in a closed state in response to the signal being greater than a second preselected magnitude 92. The first and second preselected magnitudes can be identical to each other or different from each other. The controller 70 is configured to place the exhaust gas recirculation valve 52 in an open state 84 in response to the engine 12 being turned off and to place the exhaust gas recirculation valve in the closed state in response to the signal being less than a third preselected magnitude 86. The controller 70 is configured to place the EGR valve in a partially opened condition in response to the signal being less than a maximum speed 88 of the engine 12 and greater than the third preselected magnitude 86. The precise condition of the EGR valve is determined by the controller 70 as a function of the magnitude of the signal as it changes between the third preselected magnitude 86 and the maximum speed 88 of the engine 12. The controller 70 is configured to coordinate the operation of the EGR valve 52 and the idle exhaust relief valve 42 as a function of the signal provided by the controller 70.

Although the present invention has been described with particular specificity and illustrated to show a preferred embodiment, it should be understood that alternative embodiments are also within its scope.

We claim:

1. A marine propulsion device comprising:

an engine;

an intake conduit configured to direct air into at least one combustion chamber of said engine;

an exhaust conduit configured to direct exhaust gas from said at least one combustion chamber of said engine;

an exhaust gas recirculation conduit connected in fluid communication between said exhaust conduit and said intake conduit;

an exhaust gas recirculation valve disposed in fluid communication with said exhaust gas recirculation conduit and configured to selectively inhibit the flow of said exhaust gas through said exhaust gas recirculation conduit, said exhaust gas recirculation valve having an open state which permits said exhaust gas to flow through said exhaust gas recirculation conduit and a closed state which inhibits said exhaust gas from flowing through said exhaust gas recirculation conduit;

an idle exhaust relief conduit connected in fluid communication with said exhaust conduit;

an idle exhaust relief valve disposed in fluid communication with said idle exhaust relief conduit and configured to selectively inhibit the flow of gas through said idle exhaust relief conduit, said idle exhaust relief valve having an open state which permits said gas to flow through said idle exhaust relief conduit and a closed state which inhibits said gas from flowing through said idle exhaust relief conduit; and a sensor configured to provide a signal which is representative of an operating speed of said marine propulsion device.

2. The marine propulsion device of claim 1, wherein:

said sensor is a rotational speed sensor and said operating speed of said marine propulsion device is the rotational speed of a crankshaft of said engine.

3. The marine propulsion device of claim 1, wherein:

said controller is configured to coordinate the operation of said exhaust gas recirculation valve and said idle exhaust relief valve as a function of said signal.

4. The marine propulsion device of claim 1, further comprising:

a controller connected in signal communication with said sensor, said exhaust gas recirculation valve and said idle exhaust relief valve.

5. The marine propulsion device of claim 4, wherein:

said controller is configured to place said idle exhaust relief valve in said open state in response to said signal being less than a first preselected magnitude.

6. The marine propulsion device of claim 5, wherein:

said controller is configured to place said idle exhaust relief valve in said closed state in response to said signal being greater than a second preselected magnitude.

7. The marine propulsion device of claim 4, wherein:

said controller is configured to place said exhaust gas recirculation valve in said open state in response to said engine being turned off.

8. The marine propulsion device of claim 7, wherein:

said controller is configured to place said exhaust gas recirculation valve in said closed state in response to said signal being less than a third preselected magnitude.

9. The marine propulsion device of claim 8, wherein:

said controller is configured to place said exhaust gas recirculation valve in partially opened condition in response to said signal being less than a maximum speed of said engine and greater than said third preselected magnitude, said condition of said exhaust gas recirculation valve being determined as a function of the magnitude of said signal between said third preselected magnitude and said maximum speed of said engine.

10. A marine propulsion device comprising:

an engine;

an intake conduit configured to direct air into at least one combustion chamber of said engine;

an exhaust conduit configured to direct exhaust gas from said at least one combustion chamber of said engine;

an exhaust gas recirculation conduit connected in fluid communication between said exhaust conduit and said intake conduit;

an exhaust gas recirculation valve disposed in fluid communication with said exhaust gas recirculation conduit and configured to selectively inhibit the flow of said exhaust gas through said exhaust gas recirculation conduit, said exhaust gas recirculation valve having an open state which permits said exhaust gas to flow through said exhaust gas recirculation conduit and a closed state which inhibits said exhaust gas from flowing through said exhaust gas recirculation conduit;

an idle exhaust relief conduit connected in fluid communication with said exhaust conduit;

an idle exhaust relief valve disposed in fluid communication with said idle exhaust relief conduit and configured to selectively inhibit the flow of gas through said idle exhaust relief conduit, said idle exhaust relief valve having an open state which permits said gas to flow through said idle exhaust relief conduit and a closed state which inhibits said gas from flowing through said idle exhaust relief conduit; and a sensor configured to provide a signal which is representative of an operating speed of said marine propulsion device, wherein said sensor is a rotational speed sensor and said operating speed of said marine propulsion device is the rotational speed of a crankshaft of said engine.

11. The marine propulsion device of claim 10, further comprising:

a controller connected in signal communication with said sensor, said exhaust gas recirculation valve and said idle exhaust relief valve.

12. The marine propulsion device of claim 11, wherein:

said controller is configured to place said idle exhaust relief valve in said open state in response to said signal being less than a first preselected magnitude; and said controller is configured to place said idle exhaust relief valve in said closed state in response to said signal being greater than a second preselected magnitude.

13. The marine propulsion device of claim 11, wherein:

said controller is configured to place said exhaust gas recirculation valve in said open state in response to said engine being turned off; and said controller is configured to place said exhaust gas recirculation valve in said closed state in response to said signal being less than a third preselected magnitude.

14. The marine propulsion device of claim 11, wherein:

said controller is configured to place said exhaust gas recirculation valve in partially opened condition in response to said signal being less than a maximum speed of said engine and greater than said third preselected magnitude, said condition of said exhaust gas recirculation valve being determined as a function of the magnitude of said signal between said third preselected magnitude and said maximum speed of said engine.

15. The marine propulsion device of claim 11, wherein:

said controller is configured to coordinate the operation of said exhaust gas recirculation valve and said idle exhaust relief valve as a function of said signal.

16. A marine propulsion device, comprising:

an engine;

an intake conduit configured to direct air into at least one combustion chamber of said engine;

an exhaust conduit configured to direct exhaust gas from said at least one combustion chamber of said engine;

an exhaust gas recirculation conduit connected in fluid communication between said exhaust conduit and said intake conduit;

an exhaust gas recirculation valve disposed in fluid communication with said exhaust gas recirculation conduit and configured to selectively inhibit the flow of said exhaust gas through said exhaust gas recirculation conduit, said exhaust gas recirculation valve having an open state which permits said exhaust gas to flow through said exhaust gas recirculation conduit and a closed state which inhibits said exhaust gas from flowing through said exhaust gas recirculation conduit;

an idle exhaust relief conduit connected in fluid communication with said exhaust conduit;

an idle exhaust relief valve disposed in fluid communication with said idle exhaust relief conduit and configured to selectively inhibit the flow of gas through said idle exhaust relief conduit, said idle exhaust relief valve having an open state which permits said gas to flow through said idle exhaust relief conduit and a closed state which inhibits said gas from flowing through said idle exhaust relief conduit;

a sensor configured to provide a signal which is representative of an operating speed of said marine propulsion device; and a controller connected in signal communication with said sensor, said exhaust gas recirculation valve and said idle exhaust relief valve, said controller being configured to place said idle exhaust relief valve in said open state in response to said signal being less than a first preselected magnitude, said controller being configured to place said idle exhaust relief valve in said closed state in response to said signal being greater than a second preselected magnitude, said controller being configured to place said exhaust gas recirculation valve in said open state in response to said engine being turned off, said controller being configured to place said exhaust gas recirculation valve in said closed state in response to said signal being less than a third preselected magnitude.

17. The marine propulsion device of claim 16, wherein:

said controller is configured to place said exhaust gas recirculation valve in partially opened condition in response to said signal being less than a maximum speed of said engine and greater than said third preselected magnitude, said condition of said exhaust gas recirculation valve being determined as a function of the magnitude of said signal between said third preselected magnitude and said maximum speed of said engine.

18. The marine propulsion device of claim 17, wherein:

said controller is configured to open said idle exhaust relief valve in response to a shutdown of said engine.

* * * * *